United States Patent [19]

Jeschke

[11] 4,040,349

[45] Aug. 9, 1977

[54] INK FOUNTAIN ASSEMBLY FOR PRINTING PRESSES

[75] Inventor: Willi Jeschke, Heidelberg, Germany

[73] Assignee: Heidelberger Druckmaschinen Aktiengesellschaft, Heidelberg, Germany

[21] Appl. No.: 642,485

[22] Filed: Dec. 19, 1975

[30] Foreign Application Priority Data

Dec. 19, 1974 Germany ..... 2460116

[51] Int. Cl.[2] ..... B41F 31/02

[52] U.S. Cl. ..... 101/365

[58] Field of Search ..... 101/365, 167–169, 101/148, 155, 154, 157, 161, 204, 210, 300, 302, 307, 309, 315, 321, 326, 344, 347, 330, 350, 355–356, 360, 363; 15/256.51

[56] References Cited

U.S. PATENT DOCUMENTS

| | | | |
|---|---|---|---|
| 1,862,744 | 6/1932 | Fankboner | 101/365 |
| 3,529,315 | 9/1970 | Dunlap | 15/256.51 |
| 3,699,888 | 10/1972 | Easoz | 101/365 |

*Primary Examiner*—J. Reed Fisher
*Assistant Examiner*—A. Heinz
*Attorney, Agent, or Firm*—Herbert L. Lerner

[57] ABSTRACT

Ink fountain assembly for a printing press including an ink fountain, a fountain roller engageable in the ink fountain for transferring ink therefrom to a printing unit of a printing press, an ink knife having a scraper edge on one side thereof engageable with the peripheral surface of the fountain roller for scraping ink therefrom, the ink knife being divided into individual zones on a part thereof located on the side opposite the said one side thereof on which the scraper edge is located; means for clamping the ink knife in a fixed position relative to the roller; and means for adjusting the relationship of the ink knife to the fountain roller zonewise.

10 Claims, 6 Drawing Figures

INK FOUNTAIN ASSEMBLY FOR PRINTING PRESSES

The invention relates to an ink fountain assembly for printing presses, and more particularly to such an ink fountain having an ink knife and a multiplicity of adjusting means for zonewise regulation of the ink knife adjustment with respect to an ink fountain roller.

The ink knife in printing machines is normally formed of spring steel in order to prevent wear and damage during operation. Since it is a part that wears, it must be capable of being reground and replaceable.

German Pat. No. DT-PS 613 965 discloses an ink fountain of the hereinafore described type. The ink knife of that known fountain extends over the width of the fountain and is held at the rear thereof. By means of a multiplicity of adjusting screws it can be adjusted zonewise with respect to the fountain roller. This construction, however, has the disadvantage that the adjustment of one zone screw also affects the neighbouring zones of the ink knife. A consequence thereof is that, when sensitively varying the ink knife adjustment, it is not possible to effect a limitation to a narrow strip.

It is accordingly an object of the invention to provide an ink fountain for printing presses with simple and inexpensive means that ensure sensitive zonewise adjustment or control of the amount of ink on the ink fountain roller, the ink knife being readily replaceable.

With the foregoing and other objects in view, there is provided in accordance with the invention, an ink fountain assembly for a printing press comprising an ink fountain, a fountain roller engageable in the ink fountain for transferring ink therefrom to a printing unit of a printing press, an ink knife having a scraper edge on one side thereof engageable with the peripheral surface of the fountain roller for scraping ink therefrom, the ink knife being divided into individual zones on a part thereof located on the side opposite the one side thereof on which the scraper edge is located, means for clamping the ink knife in a fixed position relative to the roller; and means for adjusting the relationship of the ink knife to the fountain roller zonewise.

In accordance with another feature of the invention, the clamping means have two clamping edges clamping therebetween the ink knife adjacent the scraper edge thereof, and the individual zones comprise respective tongues having a free outer region and extending inwardly to a location adjacent the clamping edges, the adjusting means being operatively engageable with the outer region of the tongues. Due to the slight width of the ink knife in itself or of the relatively narrow region of the ink knife wherein it is not slotted, limited ink regulation occurs during adjustment of the individual zones. In practice, the non-slotted region is about 15 mm wide. The clamping edge thus constitutes a center of rotation for the individual ink knife zones, which are pivoted thereabout, and consequently displace the scraper edge towards or lift it away from the fountain roller or ink ductor.

Ink knives which have a scraper edge interrupted by slots partly filled with synthetic material for sealing purposes have already become known heretofore. This known construction, however, entails the risk that the synthetic material in the slots will have wearing properties that are different from those of the steel ink knife per se, so that a non-uniform effect may take place there at the interruptions or slots. Morevoer, such a knife can be re-ground only to a limited extent. In addition, although zonewise regulation is required, nevertheless the transition in the ink profile between the individual zones should not be too sharpedged. If this should, in fact, occur, lateral distribution may in some cases be unable to equalize the difference.

In accordance with a particular embodiment of the invention, the adjusting means are adjustably engageable with the tongues for disengaging the scraper edge from the fountain roller or ink ductor. The ink knife consequently lies against the ductor roller in the zero or neutral position of the ink knife. Excessive pressing of individual ink knife zones against the surface of the roller, with consequent damage to the latter, is reliably avoided during the control or adjustment of the amount of ink. The opposite procedure, namely pressing of the scraper edge into contact by means of the adjusting means, is likewise possible.

In accordance with a further feature of the invention, the tongues are formed with recesses at the respective outer regions thereof, and the adjusting means extend through the recesses, respectively, and are hooked on the tongue for applying a tensile force to the latter.

In accordance with an added feature of the invention; the clamping means include a clamp bar formed with one of the clamping edges, the clamp bar and the fountain enclosing therebetween the part of the ink knife formed of the tongues.

In accordance with an additional feature of the invention, the clamping means also include a separate cross member formed with the other of the clamping edges, the clamping edges of the clamp bar and of the cross member, respectively, cooperating to hold the ink knife therebetween.

In accordance with yet another feature of the invention, the ink fountain assembly includes threaded fastening means extending through the ink knife in the part thereof formed of the tongues, and threadedly joining the ink knife to the cross member.

In accordance with yet a further feature of the invention, the clamping means include a clamp bar formed with one of the clamping edges and a part of the fountain formed with the other of the clamping edges, the part of the fountain and the clamp bar enclosing therebetween the part of the ink knife formed of the tongues.

In accordance with an added feature of the invention, the ink fountain assembly includes fastening means extending through the ink knife in the part thereof formed of the tongues and threadedly joining the ink knife to the part of the fountain.

In accordance with a concomitant feature of the invention, respective pairs of the tongues define slots therebetween, and threaded fastener means are insertable through the slots for securing the ink knife against motion relative to the ink roller. Relatively simple replacement of the ink knife in the machine is ensured by the fact that the clamp bar is joined to the fountain or the cross-member by the threaded fasteners passing through the ink knife in the region of the tongues and slots.

With an ink fountain constructed in accordance with the invention, soiling or clogging of the tongues and of the adjusting means is avoided, whether the ink knife is mounted directly on the fountain or on a separate cross-member or traverse.

The device according to the invention is also adjustable with heretofore known means by remote control, force exerting means, such as servomotors, for example, being usable for adjusting the threaded fasteners.

Other features which are considered as characteristic for the invention are set forth in the appended claims.

Although the invention is illustrated and described herein as embodied in ink fountain assembly for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
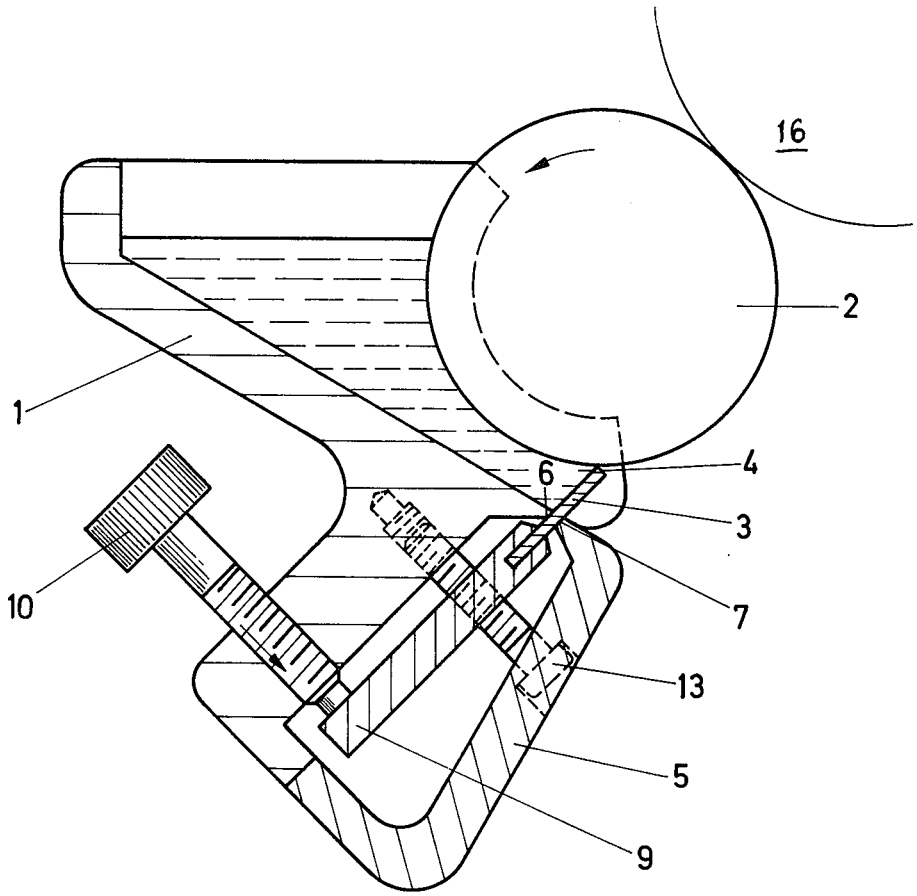
FIG. 1 is a cross-sectional view of an ink fountain assembly according to the invention.

Referring now to the drawing and, first, particularly, to FIG. 1 thereof, there is shown an ink fountain 1 cooperating in a conventional manner with a fountain roller or ink ductor 2, which transfers the ink to an inking unit, diagrammatically indicated at 16, of a printing press. An ink knife 3 is fastened to the fountain 1 and scrapes the ink off the surface of the fountain roller 2 by means of a scraper edge 4 formed on the knife 3. In the embodiment illustrated in FIG. 1, the ink knife 3 is fastened to the ink fountain 1 by means of a clamp bar 5. In this case, the ink knife 3 is held by clamping edges 6 and 7 at a short distance from the scraper edge 4.

Figure 4:
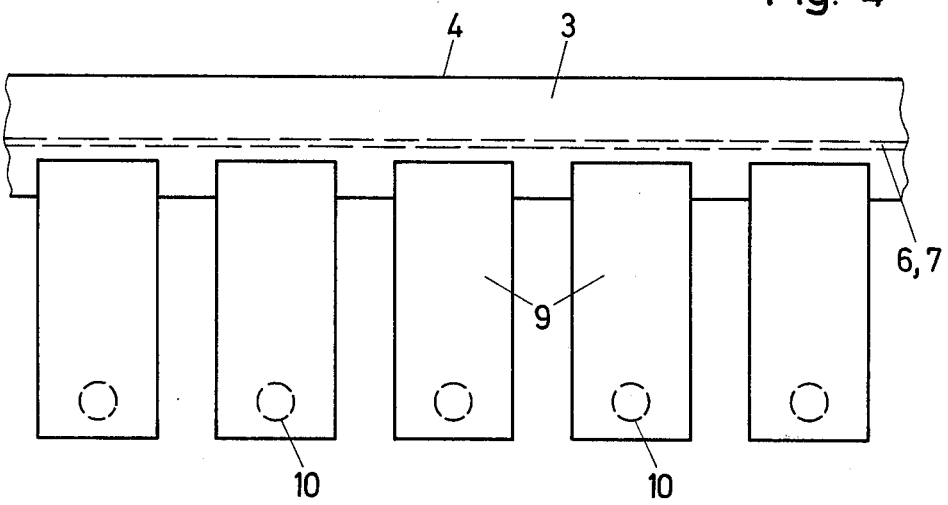
FIGS. 4, 5 and 6 are partial plan views of different embodiments of ink knives divided into individual zones that form part of the ink fountain assemblies of FIGS. 1 to 3.

Due to the disposition of clamping edge 6 formed on part of the ink fountain 1 and the clamping edge 7 formed on the clamp bar 5 in the embodiment shown in FIG. 1, a center of rotation is formed for the ink knife 3. The side of the ink knife 3 opposite to that at which the scraper edge 4 is situated, is divided into zones by individual tongues 9 (FIGS. 1 and 4). In another embodiment of the ink fountain assembly according to invention shown in FIGS. 2, 3, 5 and 6, the ink knife 3 is divided into individual tongues 9', respective pairs of the latter defining slots 8 therebetween on the side of the knife 3 opposite to that at which the scraper edge 4 is located. In this case, the slots 8 extend to a point relatively close to the clamping edges 6 and 7, the latter being in the form of narrow areas and, if necessary, being rounded.

Figure 2:
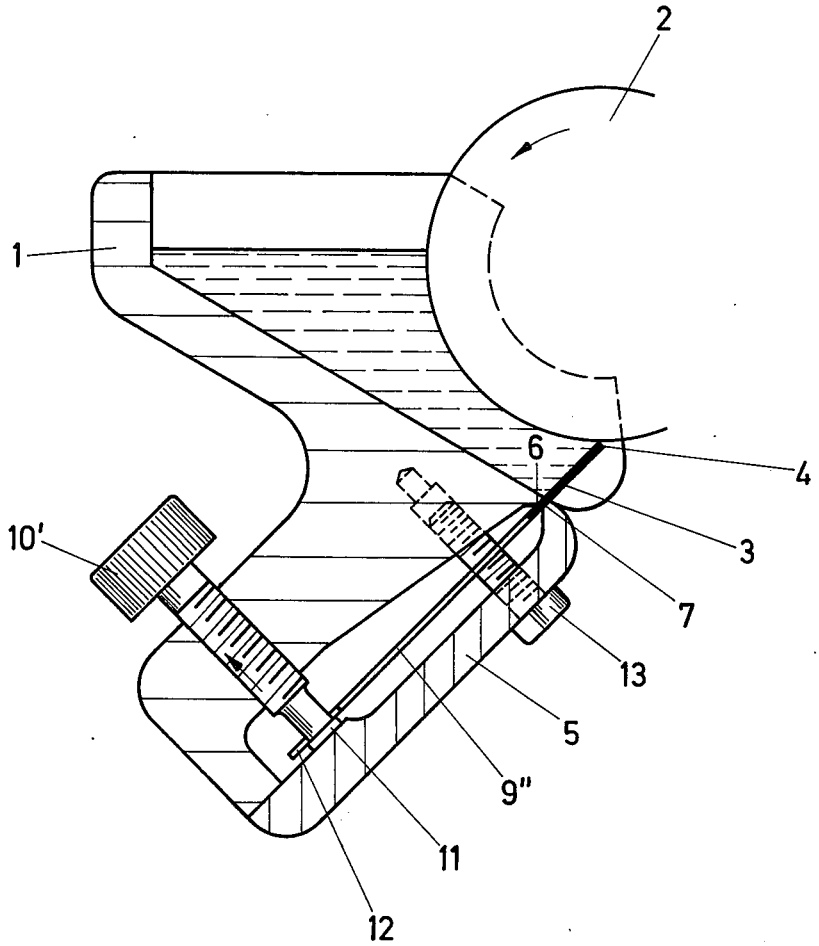
FIG. 2 is another view similar to that of FIG. 1 of another embodiment of the ink fountain assembly provided with a different type of knife.
Figure 3:
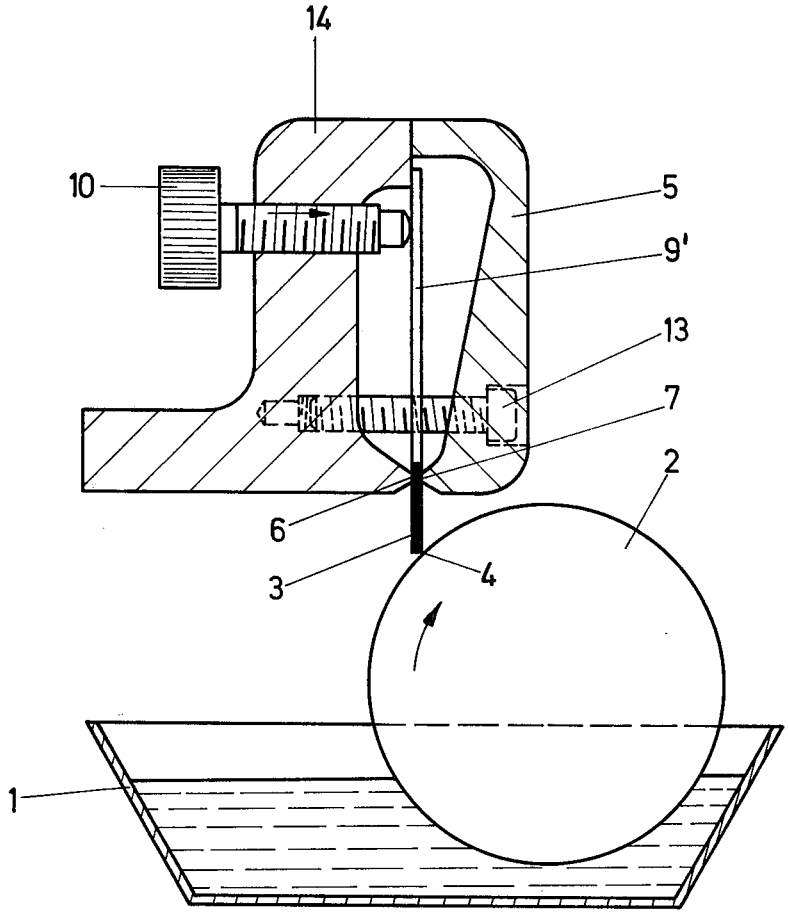
FIG. 3 is yet another view similar to that of FIG. 1 of a third embodiment of the ink fountain assembly in which the ink knife is secured to a separate beam.

In the illustrated embodiment, the adjusting means are formed of adjusting or set screws which act on the outer region of the tongues 9. In FIG. 2, the adjusting means 10' is provided with a collar 11 which hooks into a recess or cutout 12 formed in the tongue 9' and applies a tensile force to the latter in the direction of the arrow associated therewith in FIG. 2. The scraper edge 4 is thereby lifted to a greater or lesser extent off the surface of the fountain roller 2, and thus the supply of ink to the inking unit 16 is regulated zonewise. In the zero or neutral position of the ink knife 3, the scraper edge 4 lies against the surface of the fountain roller 2.

Figure 5:
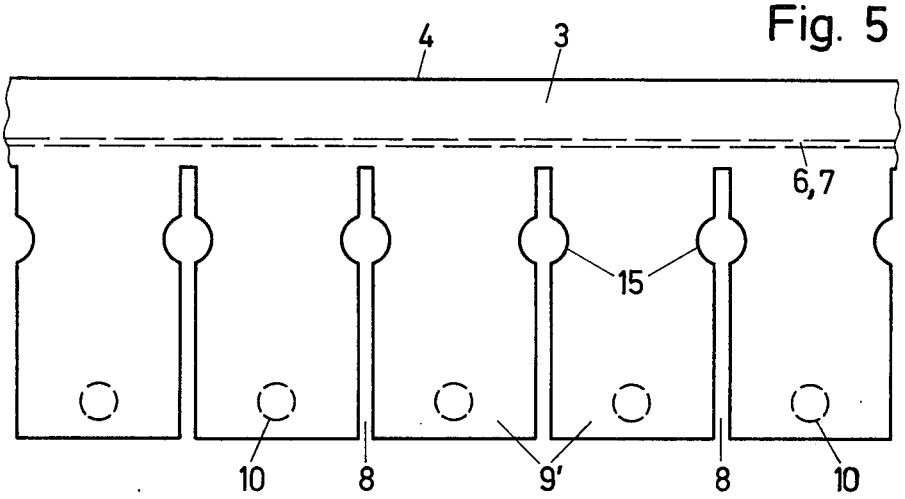
Figure 6:
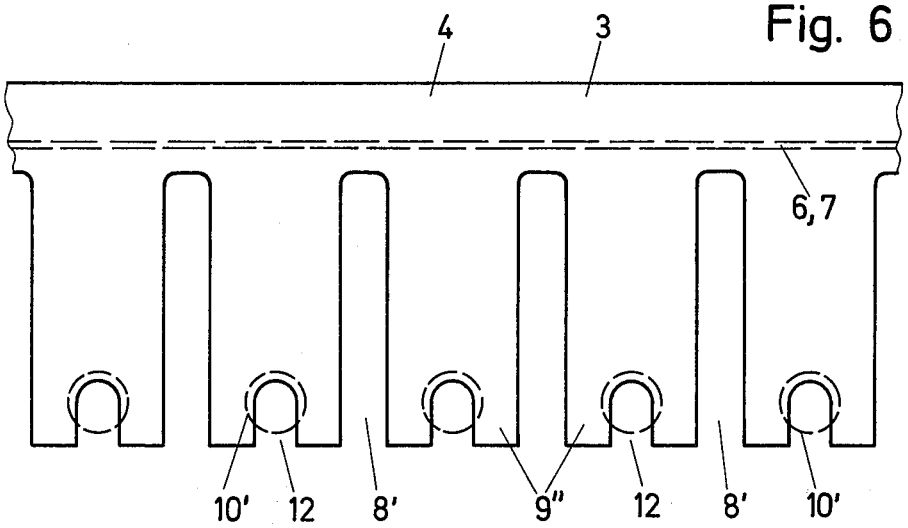

The clamp bar 5 is so constructed that in conjunction with the ink fountain 1, it surrounds the sub-divided region of the ink knife 3. The clamp bar 5 is fastened to the ink fountain 1 by means of threaded fasteners much as screws 13. In the embodiment of the invention shown in FIG. 3, the ink knife 3 is held by the clamping edge 6 formed on a separate cross-member or traverse 14 which cooperates with the clamping edge formed on the clamp bar 5. Here again, the pressure of the adjusting means 10 in the direction of the arrow associated therewith in FIG. 3 lifts the scraper edge 4 off the surface of the fountain roller 2. The ink knife 3 shown in FIG. 4 is clamped at the clamping edges 6 and 7 near the scraper edge 4. The opposite side of the ink knife 3 to that at which the scraper edge 4 lies is divided into individual zones by means of tongues 9. The tongues 9 extend to a location near the clamping edges 6 and 7, so that when the adjusting means 10 act on the outer region of the tongues 9, sensitive zonewise regulation of the amount of ink on the fountain roller 2 is effected. In the embodiment of FIG. 4, the tongues 9 are in the form of separate members secured by any suitable means to the ink knife 3. The plan view of the embodiment of the ink knife 3 in FIG. 5 shows the region acted upon by the clamping edges 6 and 7 near the scraper edge 4. On the opposite side therefrom, the ink knife 3 is divided into individual tongues 9' by slots 8, the latter extending to a point close to the clamping edges 6 and 7. In the region of the slots 8 the screws 13 pass through holes 15 formed in the ink knife 3. In this case, the adjusting means 10 act upon the outer region of the tongues 9'. In the upper part of the embodiment of the ink knife 3 shown in FIG. 6, the width of the slots 8' correspond to the diameter of the holes 15 of the embodiment of FIG. 5. Consequently, after the screws 13, in which had clamped the ink knife 3 through the slots 8', have been unscrewed, the ink knife 3 can be pulled out from between the clamping edges 6 and 7. Here again the tongues 9'' are formed with recesses or cutouts 12 in which the adjusting means 10 are hooked in a manner similar to that in the embodiment shown in FIG. 2. The construction of the ink fountain 1 and ink knife 3 and their disposition in the assembly of the invention are not limited to the illustrated embodiments. Depending upon the desired application, as mentioned hereinbefore, other embodiments may also be conceived of according to and within the scope of the invention.

There is claimed:

1. Ink fountain assembly for a printing press comprising an ink fountain, a fountain roller engageable in said ink fountain for transferring ink therefrom to a printing unit of a printing press, an elongated ink knife having a scraper edge on one side and having another side opposite and extending along the length of said scraper edge, said scraper edge being engageable with the peripheral surface of the fountain roller for scraping ink therefrom, said ink knife being divided into individual zones mutually spaced from one another along the length of said ink knife to allow the engagement of the scraper edge with the roller to be selectively adjusted by individual zones; means for holding said ink knife along a portion between said scraper edge and said opposite side in a fixed position relative to said roller; and means operatively engageable with said opposite side of said ink knife for adjusting the position of said scraper edge relative to said fountain roller zonewise.

2. Ink fountain assembly according to claim 1 wherein said holding means have two opposing clamping edges clamping therebetween said ink knife adjacent said scraper edge thereof, and said individual zones comprise respective tongues having a free outer region and extending inwardly to a location adjacent said clamping edges, said adjusting means being operatively engageable with said outer region of said tongues.

3. Ink fountain assembly according to claim 2 wherein said adjusting means are adjustably engageable with said tongues for disengaging said scraper edge from said fountain roller.

4. Ink fountain assembly according to claim 3 wherein said tongues are formed with recesses at the respective outer regions thereof, and said adjusting means extend through said recesses, respectively, and are hooked on said tongues for applying a force thereto.

5. Ink fountain assembly according to claim 2 wherein said holding means include a clamp bar formed with one of said clamping edges, said clamp bar and said fountain enclosing said tongues therebetween.

6. Ink fountain assembly according to claim 5 wherein said holding means also include a separate cross member formed with the other of said clamping edges, said clamping edges of said clamp bar and of said cross member, respectively, cooperating to hold said ink knife therebetween.

7. Ink fountain assembly according to claim 6 including threaded fastening means extending through said ink knife in the part thereof formed of said tongues, for threadedly joining said ink knife to said cross member.

8. Ink fountain assembly according to claim 5 wherein respective pairs of said tongues define slots therebetween, and including threaded fastener means insertable through said slots for securing said ink knife against motion relative to said ink roller.

9. Ink fountain assembly according to claim 2 wherein said holding means include a clamp bar formed with one of said clamping edges and a part of said fountain formed with the other of said clamping edges, said part of said fountain and said clamp bar being disposed opposite one another and enclosing therebetween the part of said ink knife formed of said tongues.

10. Ink fountain assembly according to claim 9 including fastening means extending through said ink knife in said part thereof formed of said tongues for threadedly joining said ink knife to said part of said fountain.

* * * * *